US005295316A

United States Patent [19]

Bergamin

[11] Patent Number: 5,295,316

[45] Date of Patent: Mar. 22, 1994

[54] SKI BOOT WITH OVERLAPPING SHAFT MEMBERS

[75] Inventor: Mirco Bergamin, Venice, Italy

[73] Assignee: Lange International, S.A., Fribourg, Switzerland

[21] Appl. No.: 49,626

[22] Filed: Apr. 20, 1993

Related U.S. Application Data

[63] Continuation of Ser. No. 739,789, Jul. 31, 1991, abandoned, which is a continuation of Ser. No. 558,195, Jul. 24, 1990, abandoned.

[30] Foreign Application Priority Data

Sep. 12, 1989 [CH] Switzerland ..... 3328/89

[51] Int. Cl.[5] ..... A43B 5/04

[52] U.S. Cl. ..... 36/118; 36/117

[58] Field of Search ..... 36/117, 119, 121, 118, 36/120, 50.5

[56] References Cited

U.S. PATENT DOCUMENTS

| | | | |
|---|---|---|---|
| 3,939,582 | 2/1976 | Garbuio | 36/2.5 AL |
| 4,280,286 | 7/1981 | Sartor | 36/118 |
| 4,360,979 | 11/1982 | Spademan | 36/121 |
| 4,825,566 | 5/1989 | Sartor | 36/117 |
| 4,841,650 | 6/1989 | Dodge et al. | 36/119 |
| 4,949,479 | 8/1990 | Ottieri | 36/117 |
| 5,003,710 | 4/1991 | Pozzobon | 36/117 |

FOREIGN PATENT DOCUMENTS

| | | | |
|---|---|---|---|
| 0020315 | 12/1980 | European Pat. Off. | 36/117 |

*Primary Examiner*—Paul T. Sewell
*Assistant Examiner*—Thomas P. Hilliard
*Attorney, Agent, or Firm*—Kane, Dalsimer, Sullivan, Kurucz, Levy, Eisele & Richard

[57] ABSTRACT

Boot with a shell (1) of variable volume provided with means of tightening, for example buckles (13, 14), and for rear-entry, that is to say provided with a shaft in two parts (3, 4) articulated on the shell. The front part (3) of the shaft has an indentation covered by a pair of tongues (8) provided with means of tightening (9, 10). The tongues are either integral with the front part (3) of the shaft or integral with the rear part (4) of the shaft. This boot combines the advantages of variable-volume and rear-entry boots.

3 Claims, 4 Drawing Sheets

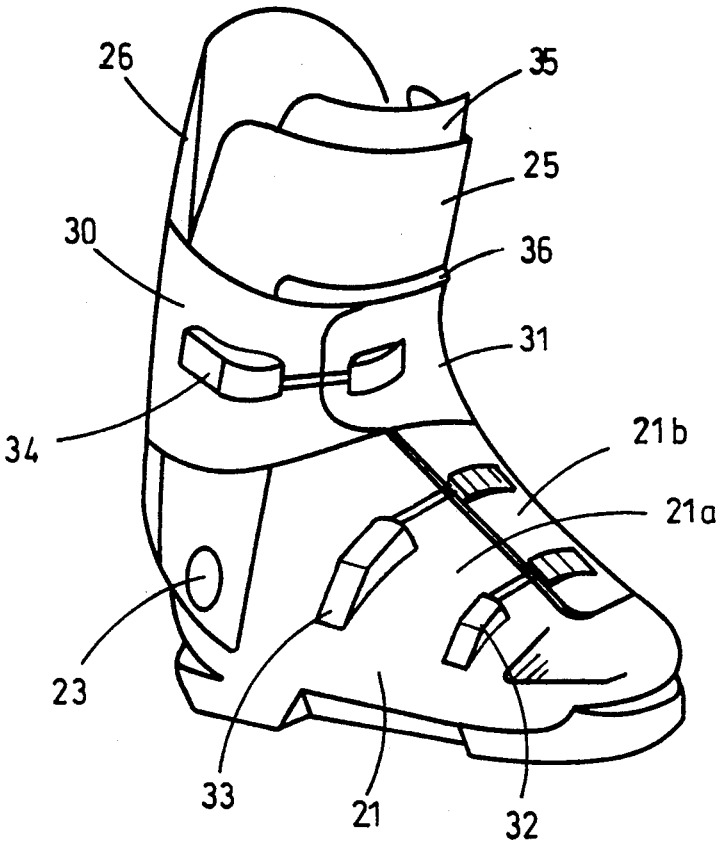
FIG. 4
FIG.5
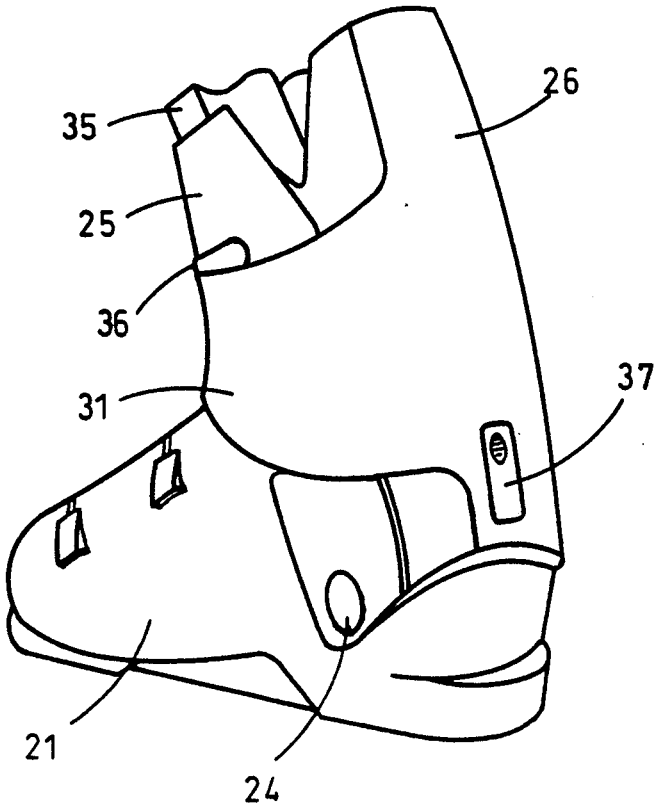

SKI BOOT WITH OVERLAPPING SHAFT MEMBERS

This is a continuation of copending application Ser. No. 07/739,789 filed on Jul. 31, 1991 now abandoned, which is a continuation of copending application Ser. No. 07/558,195 filed on Jul. 24, 1990, now abandoned.

FIELD OF THE INVENTION

The present invention relates to a ski boot consisting of a shell of variable volume surrounding the foot and the heel and of a shaft in two parts, front and rear respectively, articulated on the shell and provided with means of closing and of tightening.

PRIOR ART

Boots of variable volume and with an articulated shaft are known in particular from U.S. Pat. Nos. 3,570,148, 3,494,054 and 4,499,676. The shell is tightenable, by reduction of its volume, by means of cables and tensioning devices (U.S. Pat. No. 3,570,148) or, more conventionally, by means of buckles. This type of boot has the advantage of allowing excellent retention of the foot by the adaptation of the volume of the shell to the size of the foot. The tightening is carried out on the outside by simple means and with precision, for example by means of micrometrically adjustable buckles. The shaft is in the form of a collar which is closable and tightenable by means of cables, of tensioning devices or of buckles and does not in practice extend over the instep.

This type of boot, known as a variable-volume boot, is generally contrasted with boots known as fixed-volume boots, the shell of which is in the form of a clog. In these boots, since it is not possible to grip the foot by reducing the volume of the shell, it is necessary to provide internal tightening means which complicates the construction and causes problems of lateral retention of the foot on the inside of the boot. It has also been necessary to provide internal means of diagonal tightening, in the area of the instep, in order firmly to retain the heel in the boot.

In contrast, boots with a shell of fixed volume generally have a shaft in two parts, the rear part of which can pivot backwards, allowing entry, which gives rise to the name rear-entry boots. Such a boot is described, for example, in U.S. Pat. No. 4,539,673.

Recently, a new boot with a shell of variable volume has become known, the shaft of which consists of two parts, front and rear respectively, articulated on the shell, thus allowing rear entry. The shaft is closed by means of a cable and of a tensioning device mounted at the rear. As far as the shell is concerned, it can be tightened by means of two buckles, one of which is mounted between two tongues of the front part of the shaft which extend obliquely from the articulations in the direction of the instep, in an indentation of the front part of the shaft which exposes the instep, the buckle thus ensuring diagonal tightening of the boot. This boot, therefore, combines the advantages of variable-volume boots and of rear-entry boots.

SUMMARY OF THE INVENTION

The object of the present invention is to simplify and to improve the integration of the two types of boot.

The ski boot according to the invention is a boot wherein the front part of the shaft has an indentation which exposes the part of the shell over the instep, the exposed zone being covered, at least in the closed position of the boot, by a pair of opposite tongues which are integral with one of the parts of the shaft, extend essentially horizontally on each side of the shaft from the rear towards the front and come to overlap in said exposed zone, the means of closing and of tightening of the shaft being arranged so as to exert a traction towards the rear on at least one of said tongues.

The tongues can be integral with the front part or the rear part of the shaft.

The means of closing and of tightening ensure simultaneously the closing of the shaft and the diagonal tightening of the boot. The shaft takes the form of a shaft of variable size in the area of the instep. No open indentation subsists above the instep, but the superposition of the tongues, which envelop the front of the ankle, ensures a certain rigidity of the shaft, good lateral holding and adequate impermeability in the area of the instep.

In the case in which the tongues are integral with the rear part of the shaft, the lateral holding can moreover be further improved by providing, in the sides of the front part of the shaft, profiles into which the tongues come to fit in such a manner that, in the closed position, the shaft forms a monolithic whole.

BRIEF DESCRIPTION OF THE DRAWINGS

The attached drawing represents, by way of example, two embodiments of the ski boot according to the invention.

FIG. 4 represents a second embodiment, closed, seen from the outer side of the foot.

FIG. 5 represents the boot from FIG. 4, closed, seen from the inner side of the foot.

DESCRIPTION OF THE PREFERRED EMBODIMENTS

Figure 1:
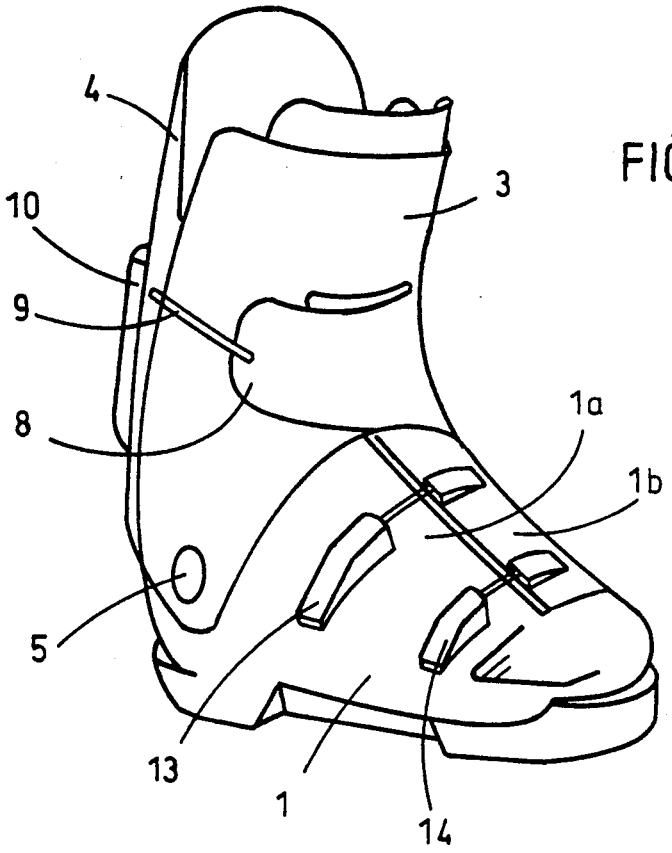
FIG. 1 represents a first embodiment, closed, seen from the outer side of the foot.
Figure 2:
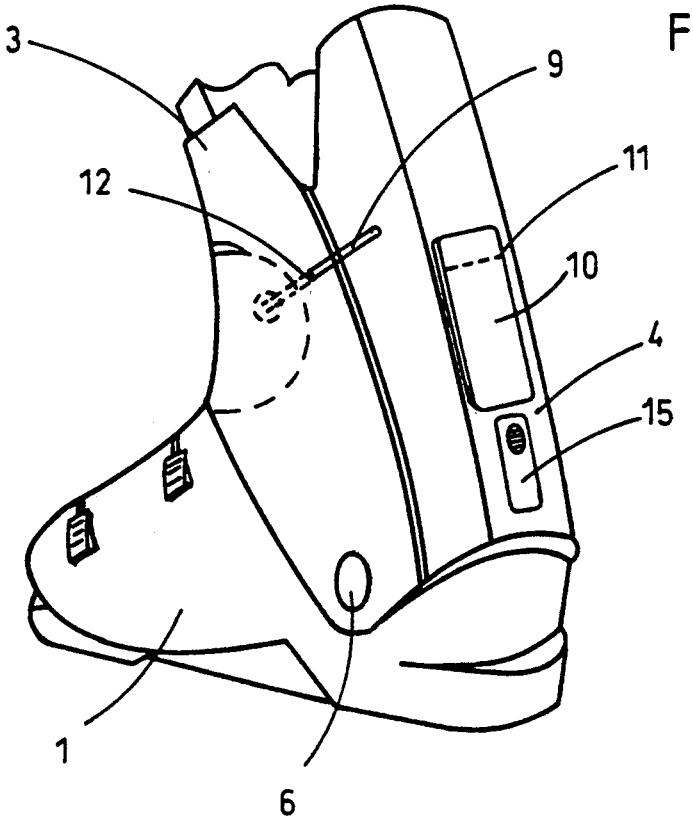
FIG. 2 represents the same boot, closed, seen from the inner side of the foot.
Figure 3:
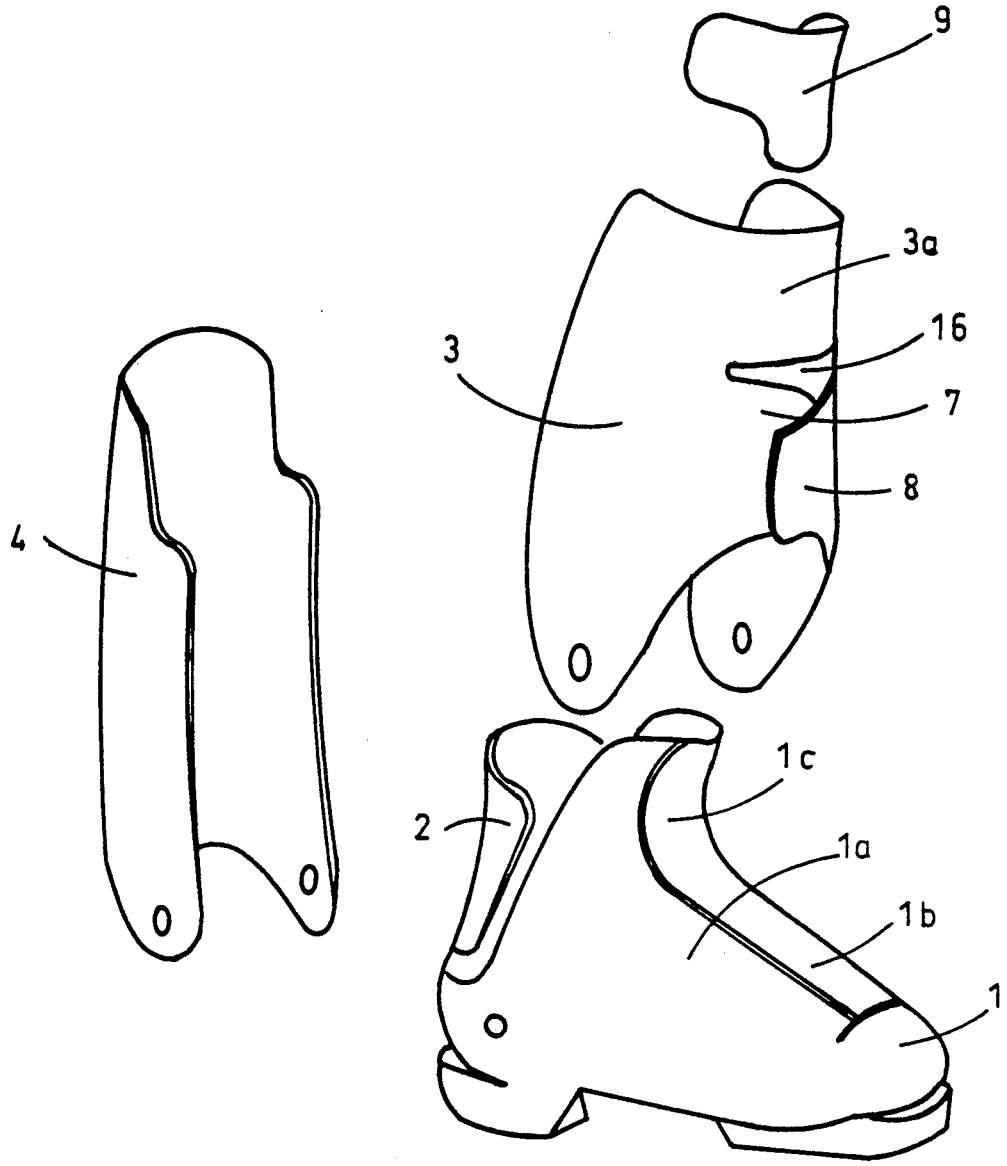
FIG. 3 is an exploded view of the constituent parts of the boot, without the means of tightening.

The boot represented in FIGS. 1 to 3 consists of a shell 1 of variable volume surrounding the foot and the heel, the variable volume being obtained, in known manner, by means of two flaps 1*a* and 1*b* extending above the instep in the manner of a boot lower shaft. The shell 1 is provided at the rear with a tongue 2 connected to the shell by a narrow part, in known manner, which allows the tongue 2 to bend forwards and backwards readily (FIG. 3).

A shaft consisting of a front part 3 and of a rear part 4 is articulated on the shell 1. These parts 3 and 4 are articulated on each side of the shell 1 by means of rivets 5 and 6. The rear part 4 of the shaft comes to fit in known manner into the front part 3. The front part 3 has on its front an indentation 16 (FIG. 3) which exposes the zone 1*c* of the shell in the area of the instep. This indentation allows a relatively rigid part to subsist, which consists of two lateral parts and of a part 3*a* adjoining the upper edge of the shaft. The indentation is occupied by two opposite tongues 7 and 8 which are integral with the part 3, extend on the sides of the shaft towards the front of the boot and come to be superposed over the instep. The ends of the tongues 7 and 8 are attached to the ends of a cable 9 which itself is attached to a tensioning lever 10 articulated in its upper part about a horizontal axis 11 on the back of the rear part 4 of the shaft. On the inner side of the boot, the cable 9 passes through the front part 3 of the shaft through a passage 12. The shell 1 is provided with two buckles 13 and 14 connecting the parts 1*a* and 1*b*, for example buckles such as those described in U.S. Pat. No. 4,051,611. At the rear, the boot is moreover provided with a device 15 which makes it possible to lock the shaft in a forward position. Such a device is described in the U.S. Pat. No. 4,499,676.

To put the boot on, the tensioning lever 10 is raised, which has the effect of releasing an adequate length of cable to allow the pivoting towards the rear of the rear part 4 of the shaft and the relaxation of the tongues 7 and 8. Once the foot has been introduced into the boot, the rear part 4 of the shaft is pushed back towards the front and the tensioning lever 10 is lowered, which has the effect of pulling on the tongues 7 and 8 and of tightening the shaft. As the tongues 7 and 8 also extend over the instep, the tightening of these tongues also has the effect of exerting a pressure on the instep and consequently of pushing the heel back into its receptacle as if there were diagonal tightening. According to a simplified alternative embodiment, one of the ends of the cable 9, on the inner side of the boot, could be fixed to the lateral part of the front part 3 of the shaft instead of being fixed to the tongue 7. In this case, the fixing would be approximately in the place of the passage 12, FIG. 2.

The tensioning lever 10 represented could be replaced by any other traction device working vertically, horizontally or rotationally, that is to say of the winder drum type. As far as the cable 9 is concerned, it could be replaced by any similar means such as a belt or other means.

Figure 6:
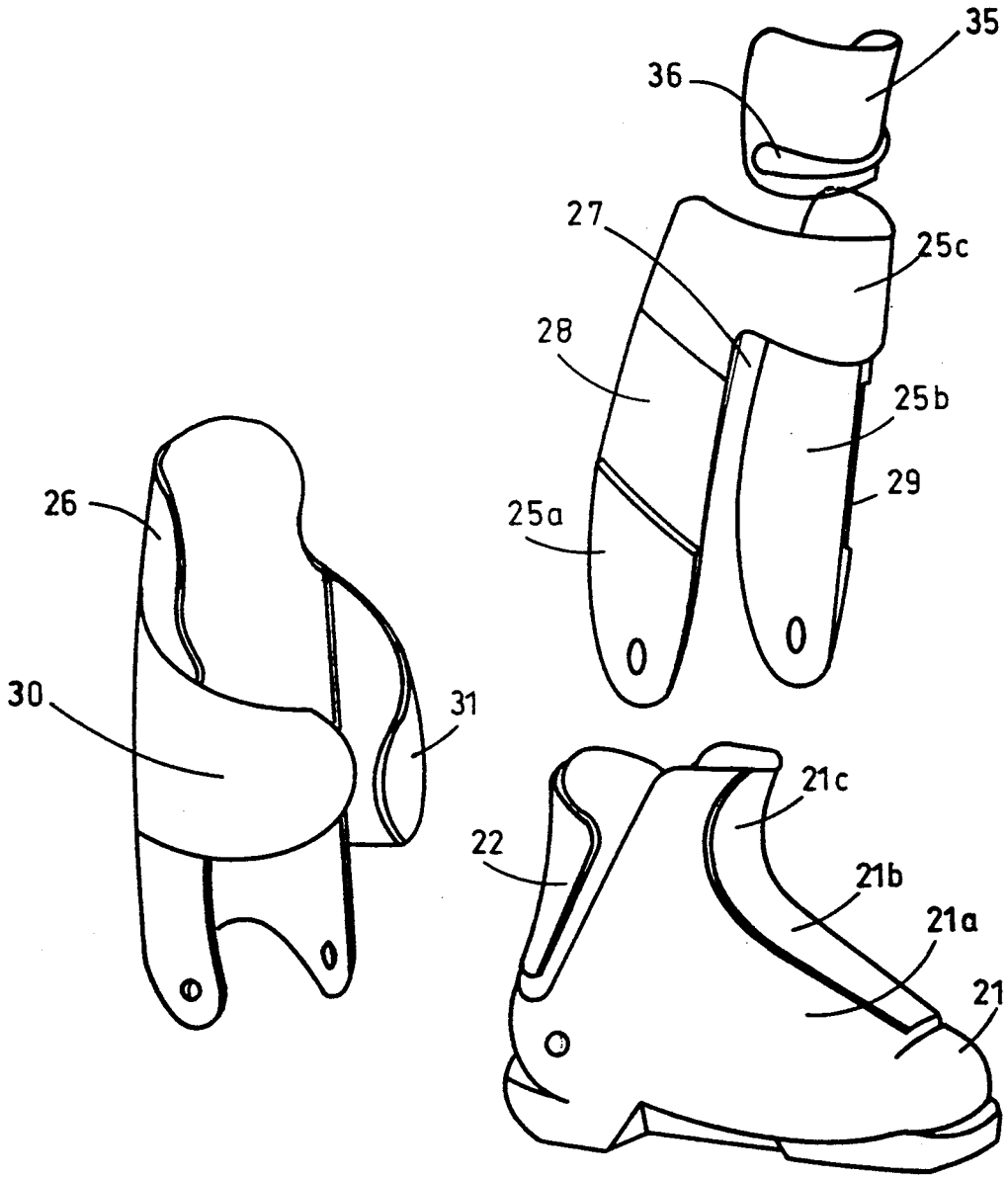
FIG. 6 is an exploded view of the constituent parts of the same boot, without the means of tightening.

The boot according to the second embodiment, represented in FIGS. 4 to 6, consists of a shell 21 of variable volume which has, over the top of the foot, two superposed flaps 21*a* and 21*b* which allow the foot to be gripped in the boot by reducing the volume of the shell. At the rear, the shell 21 is provided with a tongue 22 connected to the shell by a narrow part forming an articulation for the tongue which comes to surround and fit over the Achilles tendon. A shaft in two parts, front 25 and rear 26 respectively, is articulated on the shell 21 by means of two rivets 23 and 24. The front part 25 of the shaft consists of two lateral parts 25*a*, 25*b* which extend essentially vertically from the articulations and are connected to one another, in their upper part, by a transverse part 25*c* which delimits a large indentation 27 above the instep zone 21*c*. The lateral parts 25*a* and 25*b* have a profile 28, 29 respectively in the form of a groove. The rear part of the shaft, which comes to fit into the front part 25 is moreover provided with two tongues 30 and 31 originating from the back of the rear part 26 and extending towards the front. The shell 21 and the tongues 30 and 31 are provided with micrometrically adjustable buckles 32, 33 and 34 which each consist of a tensioning lever fixed on one of the sides of the shell or the tongue 30 respectively and of a hooking means fixed on the flap 21*b* of the shell and on the tongue 31 respectively. Such buckles are described, for example, in U.S. Pat. No. 4,051,611. In the closed position, the boot represented takes the form of a conventional three-buckle boot.

The shaft is completed by a tibial support piece 35 which comes to be placed between the top of the front part 25 of the shaft and a comfort innerboot (not shown). This tibial support piece 35 comes to cover the upper edge of the shell 21 and it is provided with a bead 36 which comes to be placed under the lower edge of the transverse part 25*c* of the front part 25 of the shaft.

In the closed position of the boot, the tongues 30 and 31 are engaged in the profiles 28 and 29 of the front part 25 and are superposed on the front of the foot, below the bead 36, forming a collar with the rear part 26 of the shaft, which collar can be tightened by means of the buckle 34. The tongues 30 and 31 are, therefore, as it were fitted into the front part 25 of the shaft in such a manner that the two parts of the shaft form a relatively rigid monolithic whole which in all cases ensures perfect lateral support of the leg, lateral support being necessary for good guiding of the skis.

The boot is of course provided with a comfort innerboot which is not shown in the drawing.

The boot represented is moreover provided, at the rear, with a locking device 37 similar to the device 15 of the first embodiment.

The relatively low position of the tongues 30 and 31 on the front of the foot has the effect of ensuring gripping of the instep, that is to say locking of the heel as in boots with diagonal tightening.

The buckle 34 could be replaced by any other means of closing and of tightening.

I claim:

1. A ski boot comprising: a shell (1; 21) of variable volume surrounding the foot and the heel; a shaft consisting of a front (3; 25) and a rear (4; 26), said front and rear being separate from each other and independently articulated on the shell to provide rear entry; and means of closing and of tightening said shell and said shaft, wherein the front has an opening (16; 27) which exposes a zone (1*c*; 21*c*) of the shell over the instep, at least in the closed position of the boot, one of said front and rear having a pair of opposite tongues (7,8; 30,31) extending forwardly to overlap in and cover said exposed zone, the means of closing and of tightening (9, 10; 34) of the shaft being arranged so as to exert a traction towards the rear on at least one of said tongues, wherein the tongues (30,31) form one piece with the rear part (26) of the shaft, and the means of closing and of tightening (34) of the shaft are situated on said tongues.

2. A ski boot comprising:

a shell (1; 21) of variable volume surrounding the foot and the heel;

a shaft consisting of a front (3; 25) and a rear (4; 26), said front and rear being separate from each other and independently articulated on the shell to provide rear entry; and means of closing and tightening said shell and said shaft, wherein the front has an opening (16; 27) which exposes a zone (1*c*; 21*c*) of the shell over the instep, at least in the closed position of the boot, one of said front and rear having a pair of opposite tongues (7, 8; 30,31) extending forwardly to overlap in and cover said exposed zone, the means of closing and of tightening (9, 10; 34) of the shaft being arranged so as to exert a traction towards the rear on at least one of said tongues wherein the tongues (30, 31) form one piece with the rear part (26) of the shaft, and the means of closing and of tightening (34) of the shaft are situated on said tongues wherein said front includes lateral parts (25*a*, 25*b*) having profiles (28, 29) into which the tongues (30, 31) fit.

3. A ski boot comprising:

a shell (21) of variable volume surrounding the foot and the heel;

a shaft consisting of a front (25) and a rear (26), said front and rear being separate from each other and independently articulated on the shell to provide rear entry; and means of closing and tightening said shell and said shaft, wherein the front has an opening (27) which exposes a zone (21*c*) of the shell over the instep, at least in the closed position of the boot, one of said front and rear having a pair of opposite tongues (30,31) extending forwardly to overlap in and cover said exposed zone, the means of closing and of tightening (34) of the shaft being arranged so as to exert a traction towards the rear on the pair of opposite tongues wherein the tongues (30, 31) form one piece with the rear part (26) of the shaft, and the means of closing and of tightening (34) of the shaft are situated on said tongues.

* * * * *